US010244314B2

(12) United States Patent
Kriegel et al.

(10) Patent No.: US 10,244,314 B2
(45) **Date of Patent: *Mar. 26, 2019**

(54) AUDIO ADAPTATION TO ROOM

(71) Applicant: Apple Inc., Cupertino, CA (US)

(72) Inventors: Adam E. Kriegel, Mountain View, CA (US); Afrooz Family, Emerald Hills, CA (US); Sean A. Ramprashad, Los Altos, CA (US); Sylvain J. Choisel, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/636,967

(22) Filed: Jun. 29, 2017

(65) Prior Publication Data

US 2018/0352333 A1 Dec. 6, 2018

Related U.S. Application Data

(63) Continuation of application No. 15/613,049, filed on Jun. 2, 2017.

(51) Int. Cl.
*H04R 29/00* (2006.01)
*H04R 3/04* (2006.01)
(Continued)

(52) U.S. Cl.
CPC ..... *H04R 3/04* (2013.01); *G10L 21/0208* (2013.01); *H04R 1/403* (2013.01); *H04R 3/12* (2013.01);
(Continued)

(58) Field of Classification Search
CPC .... H04R 29/00; H04R 29/001; H04R 29/002; H04R 3/12; H04R 3/14
(Continued)

(56) References Cited

U.S. PATENT DOCUMENTS 5,548,346 A 8/1996 Mimura et al.
5,588,065 A 12/1996 Tanaka et al.
(Continued)

FOREIGN PATENT DOCUMENTS

EP 0658064 A2 6/1995
EP 0772374 A2 5/1997
(Continued)

OTHER PUBLICATIONS

Lee, J.S. et al. "On the method for estimating the volume velocity of an acoustic source in a chamber", J. of Sound and Vibration (1995) 182(4), pp. 505-522.
(Continued)

*Primary Examiner* — Disler Paul
(74) *Attorney, Agent, or Firm* — Womble Bond Dickinson (US) LLP

(57) ABSTRACT

An audio system includes one or more loudspeaker cabinets, each having loudspeakers. The system outputs an omnidirectional sound pattern to determine the acoustic environment. Sensing logic determines an acoustic environment of the loudspeaker cabinets. The sensing logic may include an echo canceller. A playback mode processor adjusts an audio program according to a playback mode determined from the acoustic environment of the audio system. The system may produce a directional pattern superimposed on an omnidirectional pattern, if the acoustic environment is in free space. The system may aim ambient content toward a wall and direct content away from the wall, if the acoustic environment is not in free space. The sensing logic automatically determines the acoustic environment upon initial power up and when position changes of loudspeaker cabinets are detected. Accelerometers may detect position changes of the loudspeaker cabinets.

25 Claims, 4 Drawing Sheets

(51) Int. Cl.

| | |
|---|---|
| ***G10L 21/0208*** | (2013.01) |
| ***H04R 3/12*** | (2006.01) |
| ***H04R 1/40*** | (2006.01) |
| ***H04S 7/00*** | (2006.01) |
| *H04R 27/00* | (2006.01) |

(52) U.S. Cl.
CPC ..... *H04R 29/002* (2013.01); *H04S 7/305* (2013.01); *G10L 2021/02082* (2013.01); *H04R 27/00* (2013.01); *H04R 29/007* (2013.01); *H04R 2227/005* (2013.01); *H04S 7/307* (2013.01)

(58) Field of Classification Search
USPC ..... 381/58, 104–109, 103, 59
See application file for complete search history.

(56) References Cited

U.S. PATENT DOCUMENTS

| | | | | |
|---|---|---|---|---|
| 6,542,436 | B1 | 4/2003 | Myllyla | |
| 6,731,760 | B2 | 5/2004 | Pedersen | |
| 6,801,628 | B1 | 10/2004 | Thiel | |
| 7,092,535 | B1 | 8/2006 | Pedersen et al. | |
| 7,092,541 | B1 | 8/2006 | Eberbach | |
| 7,113,603 | B1 | 9/2006 | Cahill | |
| 7,433,483 | B2 | 10/2008 | Fincham | |
| 7,515,719 | B2 | 4/2009 | Hooley et al. | |
| 7,567,845 | B1 | 7/2009 | Avendano et al. | |
| 7,577,260 | B1 | 8/2009 | Hooley et al. | |
| 7,599,252 | B2 | 10/2009 | Showen et al. | |
| 7,769,183 | B2 | 8/2010 | Bharitkar et al. | |
| 8,009,516 | B2 | 8/2011 | Crowell | |
| 8,103,005 | B2 | 1/2012 | Goodwin et al. | |
| 8,107,631 | B2 | 1/2012 | Merimaa et al. | |
| 8,160,282 | B2 | 4/2012 | Christoph et al. | |
| 8,577,048 | B2 * | 11/2013 | Chaikin | H04R 29/008 381/103 |
| 8,705,769 | B2 | 4/2014 | Vickers | |
| 8,995,240 | B1 * | 3/2015 | Erven | H04B 1/20 369/2 |
| 90,078,781 | | 4/2015 | Armstrong-Muntner | |
| 9,055,371 | B2 | 6/2015 | Tammi et al. | |
| 9,097,795 | B2 | 8/2015 | Ojala et al. | |
| 9,214,913 | B2 | 12/2015 | Urup | |
| 9,307,338 | B2 | 4/2016 | Usher et al. | |
| 9,330,652 | B2 | 5/2016 | Jensen et al. | |
| 9,426,575 | B2 | 8/2016 | Kim | |
| 9,473,865 | B2 | 10/2016 | Thormundsson et al. | |
| 9,521,497 | B2 | 12/2016 | Schuster et al. | |
| 9,743,181 | B2 | 8/2017 | Choisel et al. | |
| 9,826,328 | B2 | 11/2017 | Mehta et al. | |
| 9,961,464 | B2 | 5/2018 | Porter et al. | |
| 9,992,595 | B1 | 6/2018 | Choisel et al. | |
| 2002/0067835 | A1 | 6/2002 | Vatter | |
| 2002/0168079 | A1 | 11/2002 | Kuerti et al. | |
| 2003/0007648 | A1 | 1/2003 | Currell | |
| 2003/0194097 | A1 | 10/2003 | Ding | |
| 2004/0234093 | A1 * | 11/2004 | Kawakami | H04R 1/403 381/335 |
| 2004/0257432 | A1 | 12/2004 | Girish et al. | |
| 2005/0037786 | A1 | 2/2005 | Edge | |
| 2006/0050907 | A1 | 3/2006 | Levitsky | |
| 2006/0088174 | A1 | 4/2006 | Deleeuw et al. | |
| 2006/0165247 | A1 | 7/2006 | Mansfield et al. | |
| 2007/0263888 | A1 | 11/2007 | Melanson | |
| 2007/0269071 | A1 | 11/2007 | Hooley | |
| 2007/0268642 | A1 | 12/2007 | Jung et al. | |
| 2008/0107287 | A1 | 5/2008 | Beard | |
| 2008/0168839 | A1 | 7/2008 | Katsuyama | |
| 2008/0181416 | A1 | 7/2008 | Jung | |
| 2008/0285772 | A1 | 11/2008 | Haulick et al. | |
| 2009/0052688 | A1 | 2/2009 | Ishibashi et al. | |
| 2009/0060236 | A1 | 5/2009 | Johnston et al. | |
| 2009/0196428 | A1 | 8/2009 | Kim | |
| 2010/0329489 | A1 | 12/2010 | Karaoguz | |
| 2011/0002488 | A1 | 1/2011 | Van Daele et al. | |
| 2011/0015924 | A1 | 1/2011 | Hacihabiboglu et al. | |
| 2011/0051937 | A1 | 3/2011 | Ma et al. | |
| 2011/0285809 | A1 | 11/2011 | Feng et al. | |
| 2012/0063605 | A1 | 3/2012 | Tawada | |
| 2012/0069134 | A1 | 3/2012 | Garcia, Jr. et al. | |
| 2012/0328135 | A1 | 12/2012 | De et al. | |
| 2013/0016842 | A1 | 1/2013 | Schultz-Amling et al. | |
| 2013/0170660 | A1 | 7/2013 | Kristensen et al. | |
| 2013/0230180 | A1 | 9/2013 | Thormundsson et al. | |
| 2014/0003645 | A1 | 1/2014 | Silver et al. | |
| 2014/0044286 | A1 * | 2/2014 | Coles | G06F 1/1688 381/150 |
| 2014/0072124 | A1 | 3/2014 | Stoecklmeier et al. | |
| 2014/0226837 | A1 | 8/2014 | Grokop | |
| 2014/0270274 | A1 | 9/2014 | Cohen et al. | |
| 2014/0274212 | A1 | 9/2014 | Zurek et al. | |
| 2014/0277650 | A1 | 9/2014 | Zurek et al. | |
| 2014/0307895 | A1 * | 10/2014 | Debail | H04R 3/12 381/98 |
| 2014/0335917 | A1 | 11/2014 | Tetelbaum et al. | |
| 2014/0341394 | A1 | 11/2014 | Croft, III | |
| 2015/0016642 | A1 | 1/2015 | Walsh et al. | |
| 2015/0208188 | A1 * | 7/2015 | Carlsson | H04R 29/001 381/79 |
| 2015/0237440 | A1 | 8/2015 | Fromel et al. | |
| 2015/0304789 | A1 | 10/2015 | Babayoff et al. | |
| 2016/0316305 | A1 | 10/2016 | Sheen et al. | |
| 2016/0330562 | A1 | 11/2016 | Crockett | |
| 2016/0336022 | A1 | 11/2016 | Florencia et al. | |
| 2016/0364207 | A1 | 12/2016 | Pawar et al. | |
| 2017/0006394 | A1 | 1/2017 | Risberg et al. | |
| 2017/0034617 | A1 | 2/2017 | Smith et al. | |
| 2017/0055097 | A1 | 2/2017 | Dougherty et al. | |
| 2017/0077887 | A1 | 3/2017 | You | |
| 2017/0127211 | A1 * | 5/2017 | Crockett | H04S 7/305 |
| 2018/0098166 | A1 * | 4/2018 | Schuster | H03G 5/165 |

FOREIGN PATENT DOCUMENTS

| | | | |
|---|---|---|---|
| EP | 2444967 | A1 | 4/2012 |
| EP | 1435756 | B1 | 4/2015 |
| EP | 3105943 | A1 | 12/2016 |
| WO | 2010/067250 | A2 | 6/2010 |
| WO | 2015/142868 | A1 | 9/2015 |

OTHER PUBLICATIONS

Notice of Allowance for U.S. Appl. No. 14/989,727 dated Apr. 6, 2017.

Office Action for U.S. Appl. No. 14/920,611 dated Mar. 7, 2017.

Office Action for U.S. Appl. No. 15/593,887 dated Aug. 29, 2017.

Antonacci, Fabio, et al., "Soundfield Rendering with Loudspeaker Array Through Multiple Beam Shaping", 2009 IEEE Workshop on Applications of Signal Processing to Audio and Acoustics, (Oct. 18-21, 2009), 5 pages.

Chun, Chan Jun, et al., "Real-Time Conversion of Stereo Audio to 5.1 Channel Audio for Providing Realistic Sounds", International J. of Signal Processing, Image Processing and Pattern Recognition, vol. 2., No. 4, (Dec. 2009), 85-94.

Heegaard, Frederick D., et al., "The Reproduction of Sound in Auditory Perspective and a Compatible System of Stereophony", J. audio Eng. Soc., vol. 30, No. 10, (Oct. 1992), 802-808.

Orban, Robert, "The Stero Synthesizer and Stereo Matrix: New Techniques for Generating Stereo Space", Presented at the 38th Convention, An Audio Engineering Society Reprint, (May 4-7, 1970), 7 pages.

Scarpelli, Paul, "Dipole vs. Bipole vs Monopole: Which Surround Speaker is Best?", Audioholics: Online A/V Magazine, Retrieved from the Internet: <http://www.audioholics.com/loudspeaker-design/surround-speaker-dipole-vs-bipole>: Originally published Mar. 31, 2015, (Sep. 20, 2015), 10 pages.

Thiel, Ryan D., "Array Processing Techniques for Broadband Acoustic Beamforming", University of New Orleans Theses and Dissertations, (May 20, 2005), 44 pages.

(56) References Cited

OTHER PUBLICATIONS

Williams, Michael I.Y., et al., "Generalized Broadband Beamforming Using a Model Subspace Decomposition", Eurasip J. on Advances in Signal Processing, vol. 2007, Article ID 68291, (Jan. 2007), 11 pages.
Faller, Christof, "Multiple-Loudspeaker Playback of Stereo Signals", j. Audio Eng. Sock., Viol. 54, No. 11, pp. 1051-1064, Nov. 2006.
Office Action for U.S. Appl. No. 15/275,312 dated Aug. 4, 2017.
PCT International Search Report and Written Opinion for PCT International Appln. No. PCT/US2014/057814 dated Jan. 21, 2015 (10 pages).
PCT International Preliminary Report on Patentability for PCT International Application No. PCT/US2014/057814 dated Dec. 1, 2016 (8 pages).
Office Action for U.S. Appl. No. 15/613,049 dated Aug. 4, 2017.
Office Action for U.S. Appl. No. 15/611,083 dated Aug. 15, 2017.
Office Action for U.S. Appl. No. 15/621,946 dated Aug. 9, 2017.
Notice of Allowance for U.S. Appl. No. 15/311,824 dated Sep. 8, 2017.
Final Office Action for U.S. Appl. No. 15/621,946 dated Nov. 11, 2017.
Office Action for U.S. Appl. No. 15/455,760 dated Apr. 5, 2017.
Final Office Action for U.S. Appl. No. 15/455,760 dated Oct. 30, 2017.
Non-Final Office Action received for U.S. Appl. No. 15/613,049, dated Jul. 12, 2018, 23 pages.
Non-Final Office Action received for U.S. Appl. No. 15/613,049, dated Aug. 4, 2017, 18 pages.
Final Office Action received for U.S. Appl. No. 15/613,049, dated Dec. 22, 2017, 16 pages.
European Search Report and Written Opinion received for EP Patent Application No. 18174725.4, dated Aug. 16, 2018, 10 pages.
Full Australian Examination Report dated Dec. 12, 2018, for related Australian Appln. No, 208202952 5 Pages.

* cited by examiner

AUDIO ADAPTATION TO ROOM

CROSS REFERENCE TO RELATED APPLICATIONS

This application is a continuation of application Ser. No. 15/613,049, filed Jun. 2, 2017, which is hereby incorporated by reference in its entirety.

BACKGROUND

Field

Embodiments of the invention relate to the field of rendering of audio by a loudspeaker; and more specifically, to environmentally compensated audio rendering.

Background

It is desirable to reproduce a sound recording so that it sounds as natural as in the original recording environment. The approach is to create around the listener a sound field whose spatial distribution more closely approximates that of the original recording environment. Early experiments in this field have revealed for example that outputting a music signal through a loudspeaker in front of a listener and a slightly delayed version of the same signal through a loudspeaker that is behind the listener gives the listener the impression that he is in a large room and music is being played in front of him. The arrangement may be improved by adding a further loudspeaker to the left of the listener and another to his right, and feeding the same signal to these side speakers with a delay that is different than the one between the front and rear loudspeakers. But using multiple speakers increases the cost and complexity of an audio system.

Loudspeaker reproduction is affected by nearby obstacles, such as walls. Such acoustic boundaries create reflections of the sound emitted by a loudspeaker. The reflections may enhance or degrade the sound. The effect of the reflections may vary depending on the frequency of the sound. Lower frequencies, particularly those below about 400 Hz, may be particularly susceptible to the effects of reflections from acoustic boundaries.

It would be desirable to provide an easier and more effective way to provide a natural sounding reproduction of a sound recording with fewer loudspeakers.

SUMMARY

An audio system includes one or more loudspeaker cabinets, each having loudspeakers. Sensing logic determines an acoustic environment of the loudspeaker cabinets. The sensing logic may include an echo canceller. A low frequency filter corrects an audio program based on the acoustic environment of the loudspeaker cabinets. The system outputs an omnidirectional sound pattern, which may be low frequency sound, to determine the acoustic environment. The system may produce a directional pattern superimposed on an omnidirectional pattern, if the acoustic environment is in free space. The system may aim ambient content toward a wall and direct content away from the wall, if the acoustic environment is not in free space. The sensing logic automatically determines the acoustic environment upon initial power up and when position changes of loudspeaker cabinets are detected. Accelerometers may detect position changes of the loudspeaker cabinets.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

In the following description, reference is made to the accompanying drawings, which illustrate several embodiments of the present invention. It is understood that other embodiments may be utilized, and mechanical compositional, structural, electrical, and operational changes may be made without departing from the spirit and scope of the present disclosure. The following detailed description is not to be taken in a limiting sense, and the scope of the embodiments of the present invention is defined only by the claims of the issued patent.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
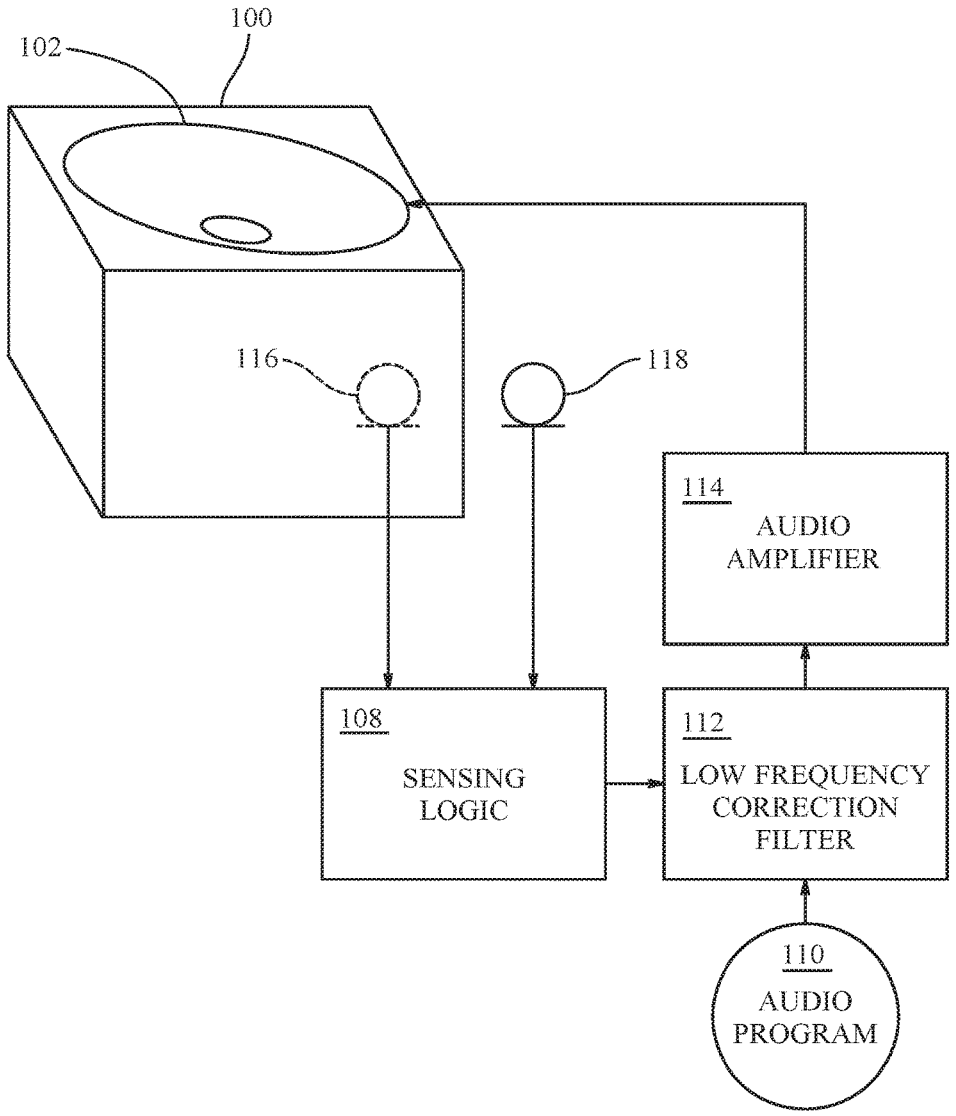
FIG. 1 is a block diagram of a first audio system that embodies the invention.

FIG. 1 is a view of an illustrative audio system. The audio system includes a loudspeaker cabinet 100, having integrated therein a loudspeaker driver 102. An audio amplifier 114 provides that is coupled to an input of the loudspeaker driver 102. Sensing logic 108 determines an acoustic environment of the loudspeaker cabinet 100 as further described below. A low frequency correction filter 112 receives an audio program 110 and produces an audio signal that corrects the audio program for room effects based on the acoustic environment of the loudspeaker cabinet 100 as further described below. The audio signal is provided to the audio amplifier 114 to output the corrected audio program through the loudspeaker driver 102 in the loudspeaker cabinet 100.

The sensing logic and the low frequency correction filter may use techniques disclosed in U.S. patent application Ser. No. 14/989,727, filed Jan. 6, 2016, titled LOUDSPEAKER EQUALIZER, which application is specifically incorporated herein, in its entirety, by reference.

Figure 2:
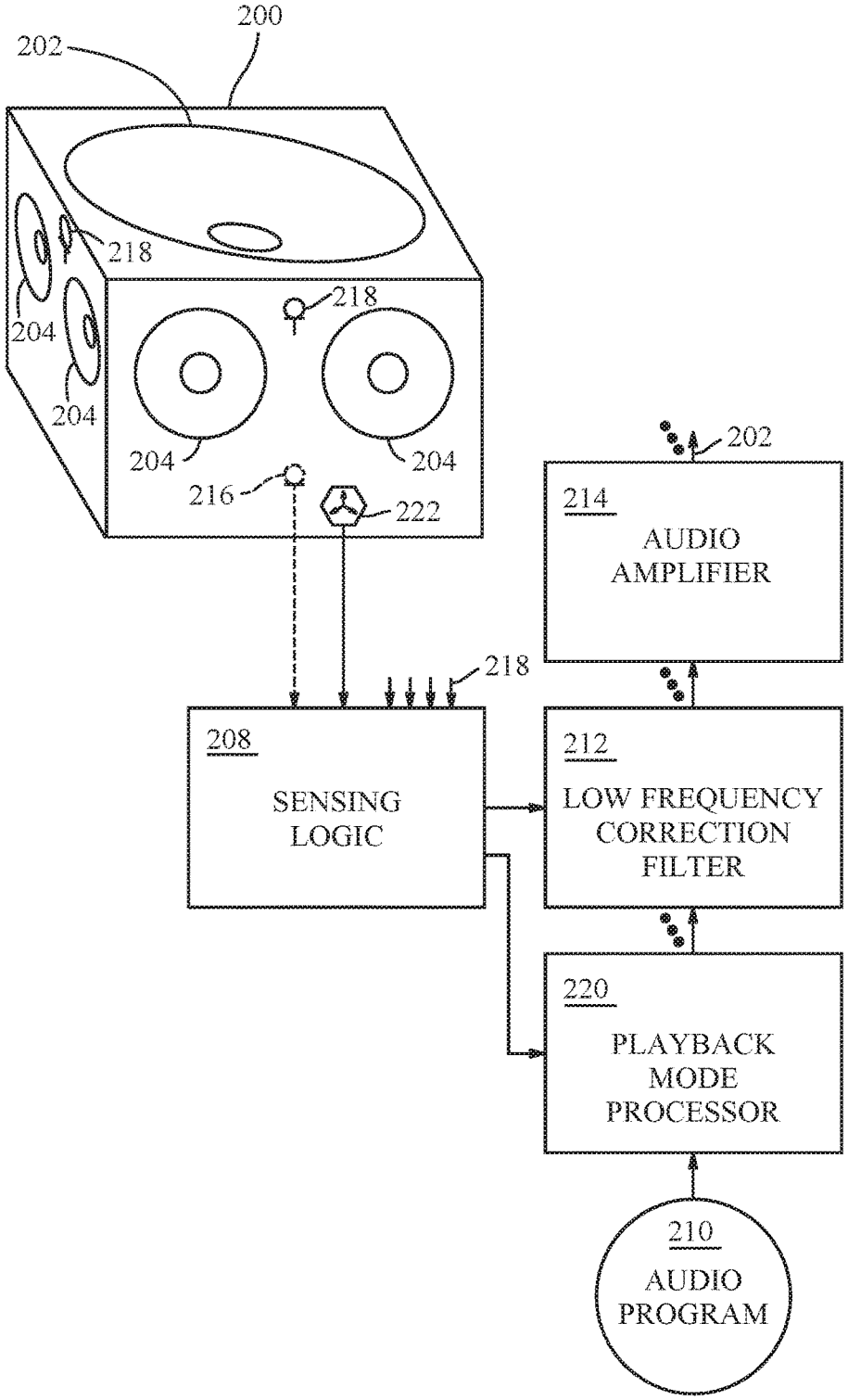
FIG. 2 is a block diagram of a second audio system that embodies the invention.

FIG. 2 is a view of another illustrative audio system. The audio system includes a loudspeaker cabinet 200, having integrated therein nine loudspeaker drivers, one driver 202 facing upward and two drivers 204 facing outward on each of the four sides of the loudspeaker cabinet.

Nine audio amplifiers 214 each provide an output coupled to an input of one of the nine loudspeaker drivers 202, 204. One audio amplifier is associated with each loudspeaker driver. Only one of the audio amplifiers is shown and the signal connections between the audio amplifiers and the loudspeaker drivers are omitted for clarity of illustration. The additional audio amplifiers and their connections to the loudspeaker drivers are suggested by ellipsis.

Sensing logic 208 determines an acoustic environment of the loudspeaker cabinet 200 as described below. One or more low frequency correction filters 212 receives an audio program 210 and produces an audio signal that corrects the audio program for room effects based on the acoustic environment of the loudspeaker cabinet 200 as described below. A low frequency correction filter 212 may be provided for every driver 202, 204 in the loudspeaker cabinet 200 or for only some of drivers, such as the drivers that provide the low frequency output, e.g. woofers and/or sub-woofers. The additional low frequency correction filters and their connections to the audio amplifiers are suggested by ellipsis for clarity.

Figure 3:
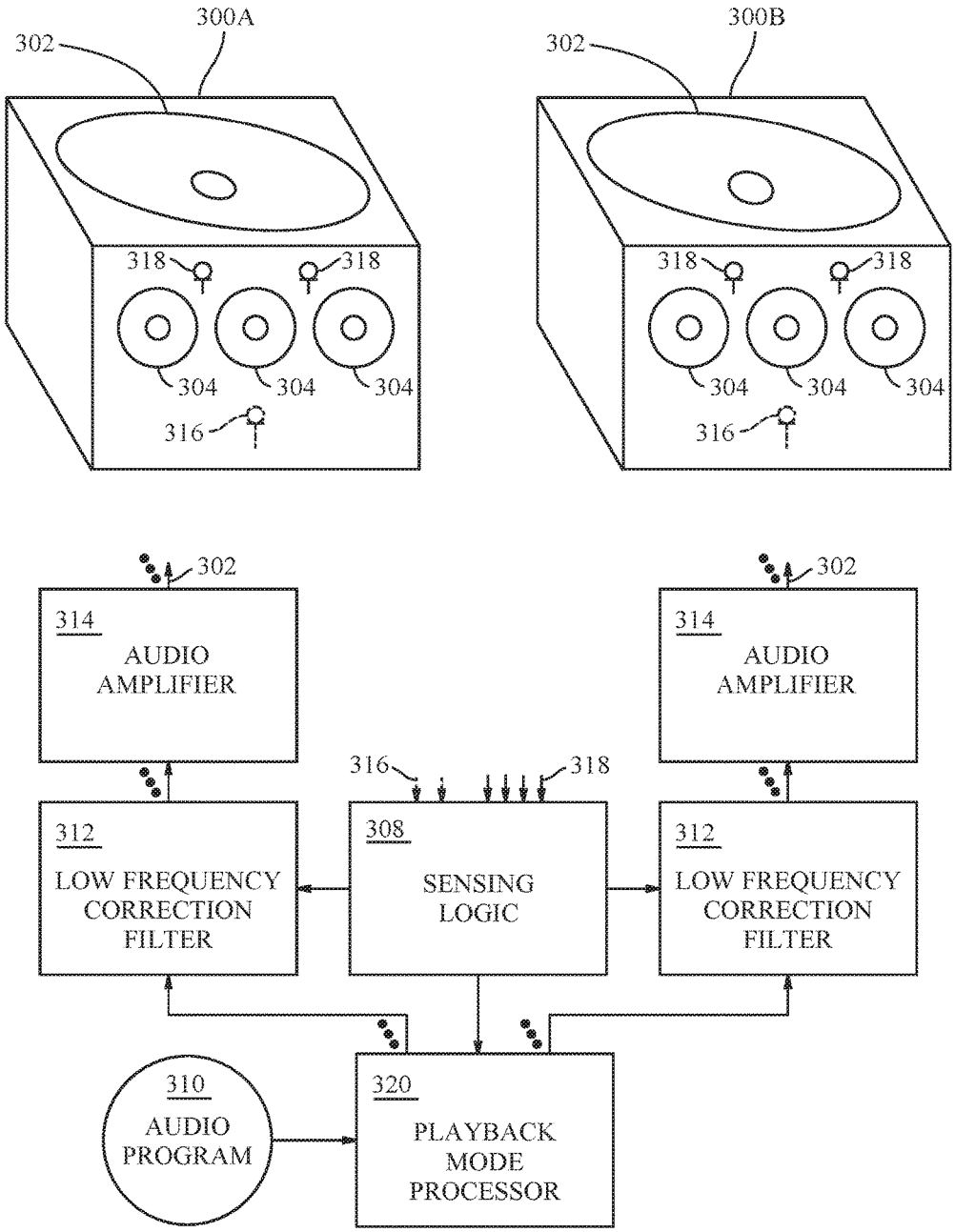
FIG. 3 is a block diagram of a third audio system that embodies the invention.

FIG. 3 is a view of yet another illustrative audio system. The audio system includes two loudspeaker cabinets 300A, 300B, having integrated therein seven loudspeaker drivers, one driver 302 facing upward and three drivers 304 facing outward on each of the forward and rearward facing sides of the loudspeaker cabinet. While two loudspeaker cabinets are shown, it will be appreciated that greater numbers of loudspeaker cabinets may be used in other audio systems that embody the invention.

Seven audio amplifiers 314 each provide an output coupled to an input of one of the seven loudspeaker drivers. One audio amplifier is associated with each loudspeaker driver. Only one of the audio amplifiers is shown and the signal connections between the audio amplifiers and the loudspeaker drivers are omitted for clarity of illustration.

Sensing logic 308 determines an acoustic environment for each of the loudspeaker cabinets 300A, 300B as described below. Two or more low frequency correction filters 312 each receive a channel of an audio program 310 and produce an audio signal that corrects the channel of the audio program for room effects based on the acoustic environment for each of the loudspeaker cabinets 300A, 300B as described below. A low frequency correction filter 312 may be provided for every driver 302, 304 in each of the loudspeaker cabinets 300A, 300B or for only some of drivers, such as the drivers that provide the low frequency output, e.g. woofers and/or sub-woofers. A low frequency correction filter may be provided for drivers in some, but not all, of the loudspeaker cabinets in an audio system that embodies the invention.

It will be appreciated that an audio system that includes two or more loudspeaker cabinets, may have one or more loudspeaker drivers arranged in various configurations, such as the configurations illustrated in FIGS. 1 and 2. Likewise, the arrangement of loudspeaker drivers illustrated in FIG. 1 may be used in an audio system that includes one loudspeaker cabinet. Arrangements of loudspeaker drivers other than those illustrated may be used in audio systems that embody the invention.

Audio systems that embody the invention include sensing logic to determine the acoustic environment of the loudspeaker drivers in the loudspeaker cabinets. It will be appreciated that the performance of loudspeaker drivers is affected by acoustic obstacles, such as walls, that can reflect and/or absorb sounds being output by the loudspeaker drivers. The acoustic properties of acoustic obstacles may be frequency dependent. Reflections may reinforce or cancel the sounds produced by the loudspeaker drivers depending on the position of the reflective acoustic surface and the frequency of the sound.

Figure 4:
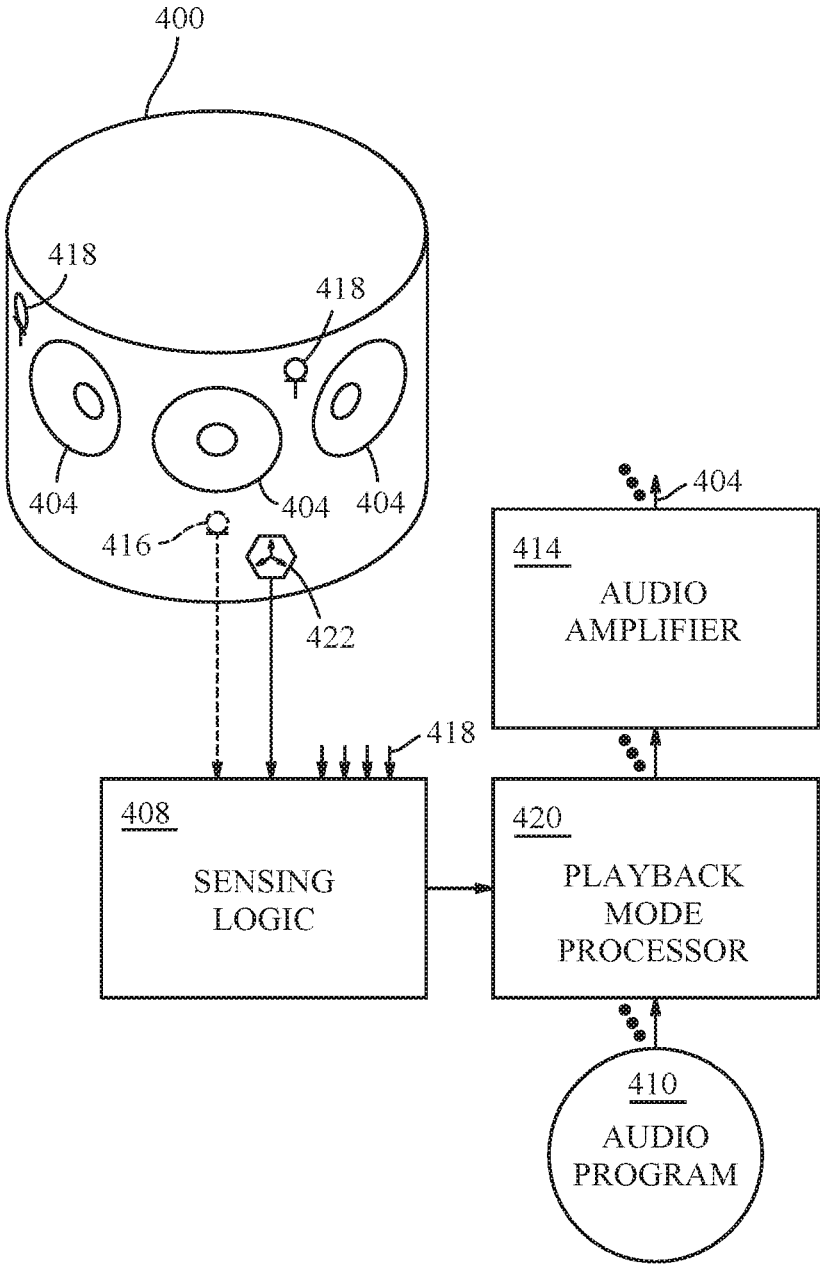
FIG. 4 is a block diagram of a fourth audio system that embodies the invention.

FIG. 4 is a view of still another illustrative audio system. The audio system includes a cylindrical loudspeaker cabinet 400, having integrated therein eight loudspeaker drivers 404, each of the drivers facing outward from the loudspeaker cabinet. It will be appreciated that other embodiments of the system may use other columnar shapes for the loudspeaker cabinet, such as octagonal or other regular polygons, that the system may use more or less than eight loudspeaker drivers, and that the system may an upward facing driver, similar to the driver disclosed in previous embodiments.

Eight audio amplifiers 414 each provide an output coupled to an input of one of the eight loudspeaker drivers 404. One audio amplifier is associated with each loudspeaker driver. Only one of the audio amplifiers is shown and the signal connections between the audio amplifiers and the loudspeaker drivers are omitted for clarity of illustration. The additional audio amplifiers and their connections to the loudspeaker drivers are suggested by ellipsis.

Sensing logic 408 determines an acoustic environment of the loudspeaker cabinet 400 as described below. A playback mode processor receives an audio program 410 and produces an audio signal that adjusts the audio program for room effects based on the acoustic environment of the loudspeaker cabinet 400 as described below. to adjust the audio program responsive to the acoustic environment of each of the one or more loudspeaker cabinets, and provide the one or more audio signals to the one or more audio amplifiers to output the corrected audio program through the one or more loudspeaker drivers in each of the one or more loudspeaker cabinets Referring again to FIG. 1, the sensing logic 108 may produce a sound pattern and provide the sound pattern to the audio amplifier 114. The sound pattern may be an omnidirectional sound pattern, a highly directive sound pattern, or another sound pattern affecting low or high audio frequencies. The sound pattern is output through the loudspeaker driver 102 in the loudspeaker cabinet 100 to determine the acoustic environment of the loudspeaker cabinet. In other embodiments, where the loudspeaker cabinet includes two or more loudspeaker drivers, the sound pattern may be output through a single loudspeaker driver in the loudspeaker cabinet or through some or all of the loudspeaker drivers in the loudspeaker cabinet. In other embodiments, where there are two or more loudspeaker cabinets, the sound pattern may be output through loudspeaker drivers in each of the loudspeaker cabinets sequentially, to determine the acoustic environment of each of the loudspeaker cabinets in turn.

The sensing logic 108 operates in part on information relating signals received on microphones 118 that are responsive to the sound at the outer boundaries of the loudspeaker cabinet 100 to those produced by various loudspeakers 102, which may be estimated by a microphone 116 inside the loudspeaker cabinet. The sensing logic 108 does so by looking, for example, at transfer function measurements between microphones 116, 118 and between loudspeakers 102 and microphones 118. The sensing logic 108 may receive a signal from an external microphone 118, which may be on an exterior surface of the loudspeaker cabinet 100 or placed to detect sound pressure levels near the exterior surface. For the purposes of this application the phrases "external microphone" and "microphone on the exterior of a loudspeaker cabinet" mean a microphone placed so that it produces signals responsive to sound pressure levels near the exterior surface of the loudspeaker cabinet.

The sensing logic 108 compares the signal from the external microphone 118 to a signal that indicates the amount of sound energy being output by the speaker driver 102. The indication of driver output sound energy may be provided by an internal microphone 116. In other embodiments, the indication of driver output sound energy may be provided by an optical system that measures the displacement of a speaker cone for the loudspeaker driver or an electrical system that derives the indication of driver output sound energy from the electrical energy being provided to the loudspeaker driver.

The sensing logic 108 estimates an acoustic path between the loudspeaker driver 102 in the loudspeaker cabinet 100 and the microphone 118 on the exterior of the loudspeaker cabinet. The sensing logic 108 may include an echo canceller to estimate the acoustic path between the loudspeaker driver 102 and the microphone 118.

The sensing logic may use other techniques to estimate the acoustic path between the loudspeaker driver and the microphone such as the techniques disclosed in U.S. patent application Ser. No. 14/920,611, filed Oct. 22, 2015, titled ENVIRONMENT SENSING USING COUPLED MICROPHONES AND LOUDSPEAKERS AND NOMINAL PLAYBACK, which application is specifically incorporated herein, in its entirety, by reference.

The sensing logic 108 may categorize the acoustic environment of the loudspeaker cabinet as being in free space, where there are no acoustic obstacles or boundaries close enough to the loudspeaker cabinet to significantly affect the sound produced by the loudspeaker drivers in the loudspeaker cabinet. For the purposes of this application the phrase "significantly affect the sound" means altering the sound to an extent that would be perceived by a listener without using a measuring apparatus. It may be assumed that the loudspeaker cabinet is designed to be supported on a surface in a way that the effects of the support surface are part of the sound intended to be produced. Thus, the support surface may not be considered to be an acoustic obstacle or boundary. A loudspeaker cabinet is in free space if it is sufficiently away from all walls and large pieces of furniture to avoid significant acoustic reflections from such obstacles.

When there are acoustic obstacles or boundaries close enough to the loudspeaker cabinet to significantly affect the sound produced by the loudspeaker drivers in the loudspeaker cabinet, i.e. when the loudspeaker cabinet is not in free space, the sensing logic 108 may further categorize the acoustic environment of the loudspeaker cabinet. The further categorization may be based on typical placements of the loudspeaker cabinet. For example, the acoustic environment may be further categorized as near a wall if there is a single reflective acoustic surface near the loudspeaker cabinet. The acoustic environment may be further categorized as in a corner if there are two reflective acoustic surfaces at right angles to each other near the loudspeaker cabinet. The acoustic environment may be further categorized as in a bookcase if there are three reflective acoustic surfaces at right angles to each other near the loudspeaker cabinet with one acoustic surface parallel to the support surface for the loudspeaker cabinet.

Referring again to FIG. 2, the audio system may provide a playback mode processor 220 to receive the audio program and adjust the audio program according to a playback mode determined from the acoustic environment of the audio system. Audio systems that provide a playback mode processor will generally include one or more loudspeaker cabinets that each include more than one loudspeaker driver.

The playback mode processor 220 adjusts the portion of the audio program 210 directed to a loudspeaker cabinet 200 to affect how the audio program is output by the multiple loudspeaker drivers 202, 204 in the loudspeaker cabinet. The playback mode processor 220 will have multiple outputs for the multiple loudspeaker drivers as suggested by ellipsis for clarity. The low frequency correction filter 212, if used for a particular driver, may be placed before or after the playback mode processor 220.

The playback mode processor 220 may adjust the audio program 210 to output portions of the audio program in particular directions from the loudspeaker cabinet 200. Sound output directions may be controlled by directing portions of the audio program to loudspeaker drivers that are oriented in the desired direction. Some loudspeaker cabinets may include loudspeaker drivers that are arranged as a speaker array. The playback mode processor may control sound output directions by causing a speaker array to emit a beamformed sound pattern in the desired direction.

The playback mode processor 220 may adjust the audio program 210 to cause the loudspeaker drivers 202, 204 to produce a directional pattern superimposed on an omnidirectional pattern, if the acoustic environment is in free space. The directional pattern may include portions of the audio program 210 that are spatially located in the sound field, e.g. portions unique to a left or right channel. The directional pattern may be limited to higher frequency portions of the audio program 210, for example portions above 400 Hz, which a listener can more specifically locate spatially. The omnidirectional pattern may include portions of the audio program 210 that are heard throughout the sound field, e.g. portions common to both the left and right channels. The omnidirectional pattern may include lower frequency portions of the audio program 210, for example portions below 400 Hz, which are difficult for a listener to locate spatially.

The playback mode processor 220 may adjust the audio program 210 to cause the loudspeaker drivers 202, 204 to aim ambient content of the audio program toward a wall and to aim direct content of the audio program away from the wall, if the acoustic environment is not in free space.

If the acoustic environment is categorized as in a bookcase, the playback mode processor 220 may adjust the audio program 210 to cause the loudspeaker drivers 202, 204 to form a highly directional beam directed out of the bookcase.

The playback mode processor may adjust the audio program using techniques described in U.S. patent application Ser. No. 15/593,887, filed May 12, 2017, titled SPATIAL AUDIO RENDERING STRATEGIES FOR BEAMFORMING LOUDSPEAKER ARRAY, which application is specifically incorporated herein, in its entirety, by reference. The playback mode processor may separate the ambient content of the audio program from the direct content using techniques described in U.S. patent application Ser. No. 15/275,312, filed Sep. 23, 2016, titled CONSTRAINED LEAST-SQUARES AMBIENCE EXTRACTION FROM STEREO SIGNALS, which application is specifically incorporated herein, in its entirety, by reference.

The sensing logic 208 may make implicit assumptions on which signals and sound sources dominate various loudspeakers and microphones when the sensing logic 208 is making use of such metrics. Also, practically, it must also be true that there are sufficient signal levels, above internal device and environmental noises, in operation to allow for valid measurements and analyses. Such levels and transfer functions, and assumptions in their estimation, can be required in various frequency bands, during various time intervals, or during various "modes" of operation of the device.

Outside of a lab or controlled setting, in a real deployment of the device, it is necessary to ensure that the sensing logic 208 algorithms operate under such valid assumptions, as are necessary for a particular sensing logic operation and decision. To help ensure that the sensing logic 208 is operating with valid inputs, the sensing logic may include "oversight" logic.

Oversight logic, in its simplest form, takes in various signals and makes absolute and relative signal level measurements and comparisons. In particular, the oversight logic checks these measurements and comparisons against various targets and tuned assumptions, which constitute tests, and flags issues whenever one or more tests/assumptions are violated. The oversight logic can probe such flags to check the status of various tests before making sensing logic decisions and changes. Flags can also, optionally, drive or gate various "estimators" in the sensing logic, warning them that necessary assumptions or conditions are being violated.

The oversight logic is designed to be flexible in that it can be tuned to look at one or more user-defined frequency bands, it can take in one or more microphone signals, and it can be tuned with various absolute and relative signal level targets by the user. The oversight logic may have modes where one or more tests are either included or excluded, depending on the scenario what the sensing logic needs this particular oversight logic to do.

The oversight logic accommodates real audio signals, which are quite dynamic in time and frequency. This is especially true for music and speech. The "level" target may be dynamic to accommodate real audio signals. The "level" target may be statistical targets. The oversight logic may collect a particular type of measurement over short time intervals, e.g. intervals in the 10 s to 100 s of msec., which may be a user defined interval, and accumulates a number of such measurements over long time intervals, e.g. intervals in the order of 100 s of msec. to seconds, which may also be a user defined interval. Passing a target for this measurement type is then defined by a target level and a proportion, where the "short" measurements, as collected over the defined "long" interval, meeting the target level must exceed the define proportion in order to pass the test. Setting such levels and proportions may relate to the frequency band of interest and the type of signals expected.

The sensing logic 208 may collect a number measurements from each of the microphones used by the sensing logic over a first period of time. Each of the measurements is taken for a second period of time that is shorter than the first period of time. The sensing logic 208 compares each of the measurements to a target level to determine a proportion of the measurements that meet the target level. The second period of time may be between 10 milliseconds and 500 milliseconds and the first period of time may be at least ten times the second period of time.

The sensing logic 208 may disable application of the low frequency correction filter 212 and determination of the acoustic environment of the audio system if the proportion of the plurality measurements that meet the target level is below a threshold value.

The sensing logic 208 may automatically determine the acoustic environment of the audio system upon initial power up of the audio system, without requiring any intervention by a user of the audio system. The sensing logic 208 may further detect when there has been a change in the acoustic environment of a loudspeaker cabinet and automatically re-determine the acoustic environment of the audio system, again without requiring any intervention by the user of the audio system. The acoustic environment may be changed by moving the loudspeaker cabinet or by placing an acoustic obstacle near the loudspeaker cabinet. The change in the acoustic environment of the loudspeaker cabinet may be detected by changes in the audio characteristics.

In some embodiments, an accelerometer 222 is coupled to the loudspeaker cabinet 200 to detect a change in the position of the loudspeaker cabinet. This may allow changes in position to be detected more quickly.

The sensing logic 208 may detect changes in the acoustic environment of a loudspeaker cabinet using techniques described in U.S. patent application Ser. No. 15/611,083, filed Jun. 1, 2017, ACOUSTIC CHANGE DETECTION, which application is specifically incorporated herein, in its entirety, by reference.

If change in the acoustic environment of a loudspeaker cabinet is detected, the sensing logic 208 may fade back to omnidirectional mode and start the calibration procedure. The recalibration is largely transparent to the user. The user may hear some sort of optimization but nothing dramatic.

The low frequency correction filter 212 and/or the playback mode processor 220 may be responsive to the re-determined acoustic environment after the loudspeaker cabinet is moved.

Referring again to FIG. 3, in some embodiments the audio system includes two or more loudspeaker cabinets 302A, 302B. In such embodiments, the playback processor 320 may adjust the audio program 310 to take advantage of the multiple loudspeaker cabinets 302A, 302B.

For example, if the acoustic environment is in free space, the playback mode processor 320 may adjust the audio program 310 to cause the loudspeaker drivers 302, 304 to produce a directional pattern superimposed on an omnidirectional pattern. The omnidirectional pattern may be the same for both loudspeaker cabinets 302A, 302B while the directional patterns are specific to each loudspeaker cabinet.

The directional patterns may be directed to complement each other, such as aiming the patterns somewhat away from another loudspeaker cabinet to provide a more spread out sound.

As another example, if the acoustic environment is not in free space, the playback mode processor 320 may adjust the audio program 310 to cause the loudspeaker drivers 202, 204 to aim ambient content of the audio program toward a wall and to aim direct content of the audio program away from the wall. If there are multiple loudspeaker cabinets 302A, 302B, the ambient content may be separated to place the ambient content according to the positions of the loudspeaker cabinets. For example, with two loudspeaker cabinets 302A, 302B, the ambient content may be separated into left ambient and right ambient and sent to the left and right loudspeaker cabinets respectively. The direct content may be similarly directed to appropriately positioned loudspeaker cabinets.

The playback mode processor adjust the audio program using techniques disclosed in U.S. patent application Ser. No. 15/311,824, filed Nov. 16, 2016, titled USING THE LOCATION OF A NEAR-END USER IN A VIDEO STREAM TO ADJUST AUDIO SETTINGS OF A FAR-END SYSTEM, which application is specifically incorporated herein, in its entirety, by reference.

Referring again to FIG. 4, the audio system may provide a playback mode processor 420 to receive the audio program 410 and adjust the audio program according to a playback mode determined from the acoustic environment of the audio system. As described above for the system shown in FIG. 2, the playback mode processor 420 adjusts the portion of the audio program 410 directed to a loudspeaker cabinet 400 to affect how the audio program is output by the multiple loudspeaker drivers 404 in the loudspeaker cabinet. The playback mode processor 420 will have multiple outputs for the multiple loudspeaker drivers as suggested by ellipsis for clarity.

The playback mode processor 420 may adjust the audio program 410 to output portions of the audio program in particular directions from the loudspeaker cabinet 400. Sound output directions may be controlled by directing portions of the audio program to loudspeaker drivers that are oriented in the desired direction.

The playback mode processor 420 may adjust the audio program 410 to cause the loudspeaker drivers 402, 404 to produce a directional pattern superimposed on an omnidirectional pattern, if the acoustic environment is in free space. The directional pattern may include portions of the audio program 410 that are spatially located in the sound field, e.g. portions unique to a left or right channel. The directional pattern may be limited to higher frequency portions of the audio program 410, for example portions above 400 Hz, which a listener can more specifically locate spatially. The omnidirectional pattern may include portions of the audio program 410 that are heard throughout the sound field, e.g. portions common to both the left and right channels. The omnidirectional pattern may include lower frequency portions of the audio program 410, for example portions below 400 Hz, which are difficult for a listener to locate spatially.

The playback mode processor 420 may adjust the audio program 410 to cause the loudspeaker drivers 404 to aim ambient content of the audio program toward a wall and to aim direct content of the audio program away from the wall, if the acoustic environment is not in free space.

The sensing logic 408 may use oversight logic as described above for the system shown in FIG. 2.

In some embodiments, an accelerometer 422 is coupled to the loudspeaker cabinet 400 to detect a change in the position of the loudspeaker cabinet. This may allow changes in position to be detected more quickly.

If a change in the acoustic environment of a loudspeaker cabinet is detected, the sensing logic 408 may fade back to omnidirectional mode and start the calibration procedure. The recalibration is largely transparent to the user. The user may hear some sort of optimization but nothing dramatic. The playback mode processor 420 may be responsive to the re-determined acoustic environment after the loudspeaker cabinet is moved.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. Not every step or element described is necessary in audio systems that embody the invention. Individual steps or elements described in connection with one embodiment may be used in addition to or to replace steps or elements described in connection with another embodiment. The description is thus to be regarded as illustrative instead of limiting.

What is claimed is:

1. An audio system comprising:

a loudspeaker cabinet, having integrated therein a plurality of loudspeaker drivers coupled to be driven by an audio power amplifier subsystem and a microphone on an exterior of the loudspeaker cabinet;

a playback mode processor to receive an audio program, adjust the audio program according to a playback mode determined from an acoustic environment of the loudspeaker cabinet, produce driver input audio signals for the plurality of loudspeaker drivers to output portions of the audio program in particular directions from the loudspeaker cabinet according to the adjusted audio program, and provide the driver input audio signals to the audio power amplifier subsystem to output the adjusted audio program through the plurality of loudspeaker drivers in the loudspeaker cabinet;

sensing logic to cause the playback mode processor to output an omnidirectional sound pattern through the plurality of loudspeaker drivers in the loudspeaker cabinet, to collect a plurality of measurements from the microphone on the exterior of the loudspeaker cabinet over a first period of time, each of the plurality of measurements being for a second period of time that is shorter than the first period of time, to compare each of the plurality of measurements to a target level and to determine a proportion of the plurality of measurements that meet the target level, and to determine the acoustic environment of the loudspeaker cabinet includes a wall or a bookshelf close to the loudspeaker cabinet only if the proportion of the plurality of measurements that meet the target level is above a threshold value.

2. The audio system of claim 1, wherein the sensing logic includes an echo canceller to estimate an acoustic path between the plurality of loudspeaker drivers in the loudspeaker cabinet and the microphone on the exterior of the loudspeaker cabinet, and determine the acoustic environment of the loudspeaker cabinet.

3. The audio system of claim 1, wherein the second period of time is between 10 milliseconds and 500 milliseconds and the first period of time is at least ten times the second period of time.

4. The audio system of claim 1, further comprising a low frequency correction filter to receive the audio program, produce the driver input audio signals that correct the audio program for room effects for the loudspeaker cabinet, responsive to the acoustic environment of the loudspeaker cabinet, and provide the driver input audio signals to the audio power amplifier subsystem to output the corrected audio program through the plurality of loudspeaker drivers in the loudspeaker cabinet.

5. The audio system of claim 1, wherein if the acoustic environment includes a wall or a bookshelf close to the loudspeaker cabinet, the playback mode processor adjusts the audio program to produce a directional pattern superimposed on an omnidirectional pattern.

6. The audio system of claim 1, wherein if the acoustic environment includes a wall or a bookshelf close to the loudspeaker cabinet, the playback mode processor adjusts the audio program to aim ambient content of the audio program toward the wall or the bookshelf, and to aim direct content of the audio program away from the wall or the bookshelf.

7. The audio system of claim 1, wherein the sensing logic configures the driver input audio signals to output a low frequency sound pattern through the plurality of loudspeaker drivers to determine a direction of an obstacle.

8. The audio system of claim 1, wherein the sensing logic automatically determines the acoustic environment of the audio system upon initial power up of the audio system and when a change in a position of the loudspeaker cabinet is detected.

9. The audio system of claim 8, further comprising an accelerometer coupled to the loudspeaker cabinet to detect the change in the position of the loudspeaker cabinet.

10. The audio system of claim 1, wherein the sensing logic automatically detects a change in a position of the loudspeaker cabinet and re-determines the acoustic environment of the loudspeaker cabinet, and the adjustment of the audio program by the playback mode processor is responsive to the re-determined acoustic environment of the loudspeaker cabinet.

11. A method for outputting an audio program through a plurality of loudspeaker drivers in a loudspeaker cabinet, the method comprising:

determining an acoustic environment of the loudspeaker cabinet, the determination including outputting an omnidirectional sound pattern through the plurality of loudspeaker drivers, collecting a plurality of measurements from a microphone on the exterior of the loudspeaker cabinet over a first period of time, each of the plurality of measurements being for a second period of time that is shorter than the first period of time, comparing each of the plurality of measurements to a target level to determine a proportion of the plurality of measurements that meet the target level, and only if the proportion of the plurality of measurements that meet the target level is above a threshold value, determining the acoustic environment of the loudspeaker cabinet includes a wall or a bookshelf close to the loudspeaker cabinet;

determining a playback mode based on the acoustic environment of the loudspeaker cabinet;

adjusting the audio program to produce a plurality of audio signals; and outputting the plurality of audio signals through the plurality of loudspeaker drivers in the loudspeaker cabinet, wherein portions of the audio program are output in particular directions from the loudspeaker cabinet according to the playback mode.

12. The method of claim 11, wherein determining the acoustic environment of the plurality of loudspeaker drivers further comprises estimating an acoustic path between the plurality of loudspeaker drivers in the loudspeaker cabinet and the microphone on the exterior of the loudspeaker cabinet using an echo canceller.

13. The method of claim 11, wherein the second period of time is between 10 milliseconds and 500 milliseconds and the first period of time is at least ten times the second period of time.

14. The method of claim 11 further comprising:

determining a low frequency correction filter to correct for room effects responsive to the acoustic environment of the loudspeaker cabinet; and applying the low frequency correction filter to the audio program to correct the plurality of audio signals.

15. The method of claim 11, wherein if the acoustic environment includes a wall or a bookshelf close to the loudspeaker cabinet, the playback mode produces a directional pattern superimposed on an omnidirectional pattern.

16. The method of claim 11, wherein if the acoustic environment includes a wall or a bookshelf close to the loudspeaker cabinet, the playback mode aims ambient content of the audio program toward the wall or the bookshelf, and aims direct content of the audio program away from the wall or the bookshelf.

17. The method of claim 11, wherein determining the acoustic environment of the loudspeaker cabinet comprises determining a direction of an obstacle using a low frequency sound pattern.

18. The method of claim 11, wherein the determining the acoustic environment of the loudspeaker cabinet is automatically performed upon initial power up of the loudspeaker cabinet and when a change in a position of the loudspeaker cabinet is detected.

19. The method of claim 18, wherein the change in the position of the loudspeaker cabinet is detected using an accelerometer.

20. The method of claim 11 further comprising:

determining whether a change in position of the loudspeaker cabinet has occurred;

in accordance with a determination that the change in position has occurred, determining the acoustic environment of the loudspeaker cabinet, determining the playback mode based on the acoustic environment of the loudspeaker cabinet, wherein the plurality of audio signals are output through the plurality of loudspeaker drivers according to the playback mode, adjusting the audio program to produce the plurality of audio signals that output portions of the audio program in particular directions from the loudspeaker cabinet, and outputting the plurality of audio signals through the plurality of loudspeaker drivers.

21. An article of manufacture comprising a machine-readable non-transitory medium having instructions stored therein that, when executed by a processor:

determine an acoustic environment of a loudspeaker cabinet having a plurality of loudspeaker drivers therein, the determination including outputting an omnidirectional sound pattern through the plurality of loudspeaker drivers, collecting a plurality of measurements from a microphone on the exterior of the loudspeaker cabinet over a first period of time, each of the plurality of measurements being for a second period of time that is shorter than the first period of time, comparing each of the plurality of measurements to a target level to determine a proportion of the plurality of measurements that meet the target level, and only if the proportion of the plurality of measurements that meet the target level is above a threshold value, determining the acoustic environment of the loudspeaker cabinet includes a wall or a bookshelf close to the loudspeaker cabinet;

determine a playback mode based on the acoustic environment of the loudspeaker cabinet;

adjust an audio program to produce a plurality of audio signals; and output the plurality of audio signals through the plurality of loudspeaker drivers in the loudspeaker cabinet, wherein portions of the audio program are output in particular directions from the loudspeaker cabinet according to the playback mode.

22. The article of manufacture of claim 21, wherein the machine-readable non-transitory medium has additional instructions stored therein that, when executed by the processor:

determine a low frequency correction filter to correct for room effects responsive to the acoustic environment of the loudspeaker cabinet; and apply the low frequency correction filter to the audio program to produce the plurality of audio signals.

23. The article of manufacture of claim 21, wherein the machine-readable non-transitory medium has additional instructions stored therein that, when executed by the processor:

if the acoustic environment includes a wall or a bookshelf close to the loudspeaker cabinet, produce the plurality of audio signals as defining a directional pattern superimposed on an omnidirectional pattern.

24. The article of manufacture of claim 21, wherein the machine-readable non-transitory medium has additional instructions stored therein that, when executed by the processor:

if the acoustic environment includes a wall or a bookshelf close to the loudspeaker cabinet, aim ambient content of the audio program toward the wall or the bookshelf, and aim direct content of the audio program away from the wall or the bookshelf.

25. The article of manufacture of claim 21, wherein the machine-readable non-transitory medium has additional instructions stored therein that, when executed by the processor, automatically determine the acoustic environment of the loudspeaker cabinet upon initial power up of the processor and when a change in a position of the loudspeaker cabinet is detected.

* * * * *